US008671926B1

(12) United States Patent
Mahlstedt et al.

(10) Patent No.: US 8,671,926 B1
(45) Date of Patent: Mar. 18, 2014

(54) TOY LAUNCHER APPARATUS WITH INNER AND OUTER TUBES

(71) Applicant: Hasbro, Inc., Pawtucket, RI (US)

(72) Inventors: Curt Jonathan Mahlstedt, Bristol, RI (US); Douglas C. Weiler, Bridgewater, MA (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 13/722,302

(22) Filed: Dec. 20, 2012

(51) Int. Cl.
*F41B 11/12* (2006.01)

(52) U.S. Cl.
USPC ..... 124/65

(58) Field of Classification Search
USPC ..... 124/63–67, 79, 85; 42/85; 446/180, 446/475, 485
See application file for complete search history.

(56) References Cited

U.S. PATENT DOCUMENTS

| | | | |
|---|---|---|---|
| 961,511 | A | 6/1910 | Marble |
| 1,374,757 | A | 4/1921 | Napier |
| 1,441,975 | A | 1/1923 | Edelin |
| 2,109,589 | A | 3/1938 | Horwitt et al. |
| 2,375,607 | A | 5/1945 | Wulfert |
| 2,725,868 | A | 12/1955 | Foster |
| 2,762,356 | A | 9/1956 | Foster |
| 3,765,396 | A | 10/1973 | Klenholz et al. |
| 3,968,783 | A | 7/1976 | Pfotenhauer |
| 4,170,215 | A | 10/1979 | Kettlestrings |
| 4,248,202 | A | 2/1981 | Jaworski et al. |
| 4,659,320 | A | 4/1987 | Rich et al. |
| 5,113,842 | A | 5/1992 | Moormann |
| 5,267,549 | A | 12/1993 | Webber |
| 5,292,134 | A | 3/1994 | Schlundt et al. |
| 5,377,656 | A | 1/1995 | Lewinski et al. |
| 5,433,646 | A | 7/1995 | Tarng |
| 5,471,967 | A | 12/1995 | Matsuzaki et al. |
| 5,529,050 | A | 6/1996 | D'Andrade |
| 5,605,140 | A | 2/1997 | Griffin |
| 5,611,322 | A | 3/1997 | Matsuzaki et al. |
| 5,711,285 | A | 1/1998 | Stewart et al. |
| 5,996,564 | A | 12/1999 | Kotowski |
| 6,224,457 | B1 | 5/2001 | Wu |
| 6,598,329 | B1 | 7/2003 | Alexander |
| 6,733,356 | B2 | 5/2004 | Lee |
| 7,287,526 | B1 | 10/2007 | Bligh et al. |
| 7,418,797 | B1 | 9/2008 | Crose |
| 7,437,847 | B1 | 10/2008 | Mabry |
| 7,552,557 | B1 | 6/2009 | Mabry |
| 7,673,624 | B2 | 3/2010 | Rosella, Jr. |
| 7,938,110 | B2 | 5/2011 | Udwin |
| D658,726 | S | 5/2012 | Greiner |
| 2006/0242880 | A1 | 11/2006 | Griffin |
| 2007/0034197 | A1 | 2/2007 | Tschech |

*Primary Examiner* — Michael Carone
*Assistant Examiner* — Reginald Tillman, Jr.
(74) *Attorney, Agent, or Firm* — Perry Hoffman

(57) ABSTRACT

A toy launcher apparatus having inner and outer concentric tubes forming a chamber between the tubes. Within the inner tube in a piston and an attached rod, the piston being movable between front and rear positions by a user of the launcher apparatus. The other end of the rod is attached to a handle and upon being pulled rearward, compressed air causes discharge of a projectile. The inner tube has a closed front end portion and an open rear end portion with vents. An end cap is connected to the tubes to prevent relative movement between the tubes and to provide an air path from a region in the inner tube rearward of the piston, through the vents and into the chamber. A front cap is attached to the outer tube, a projectile restraining seal is mounted to the front cap, and a perforated cup is mounted rearward of the seal. A spring is positioned in the chamber between the inner tube and the perforated cup to bias the cup and a loaded ball toward the seal.

20 Claims, 7 Drawing Sheets

TOY LAUNCHER APPARATUS WITH INNER AND OUTER TUBES

FIELD OF THE INVENTION

The present invention relates generally to a compress air operated toy launcher apparatus, and, more particularly, to a compact launcher apparatus having two stationary concentric tubes with a user operated piston movable in an inner tube, an internal air path from the inner tube, and a projectile mounted to an outer tube.

BACKGROUND OF THE INVENTION

Toys and other devices that discharge projectiles with compressed air are well known, and are disclosed in several existing patents. By way of example, U.S. Pat. No. 2,375,607 for a "Toy Rocket Projecting Gun" issued in 1945 to Wulfert purports to disclose an air gun having upper and lower tubes with a small tube communicating air flow between the tubes. A piston and rod are movable in the lower tube and a projectile is loaded in the upper tube. When a handle attached to the rod is moved quickly to the rear, compressed air moves from the lower tube, through the small tube to the upper tube and launches the projectile. Ten years later, U.S. Pat. No. 2,725,868 for an "Air Gun" issued to Foster purporting to disclose an air gun with a barrel over a cylinder. The barrel holds multiple balls and a piston in the cylinder allows air to enter the cylinder when a handle connected to the piston is pushed forward. Compressed air enters the barrel and discharges a ball when the handle is pulled rearward. A rubber constrictor at the end of the barrel permits only one ball at a time to be discharged.

A year later, U.S. Pat. No. 2,762,356, issued to Foster for a "Repeating Air Gun" purporting to disclose an air gun operating like the air gun in his earlier patent, but where the cylinder and piston are located in a gun stock behind the barrel. U.S. Pat. No. 3,765,396, issued in 1973 to Klenholz and Lohr, entitled "Air Guns" and purports to disclose aligning a barrel with a cylinder and includes a side opening for loading. Pushing a handle attached to the barrel forward brings air into the cylinder and pulling the handle rearward launches a ball. A resilient sleeve at the forward end of the barrel meters the discharge of one ball at a time. In 1992, U.S. Pat. No. 5,113,842, entitled "Rapid fire ball Launcher," issued to Moormann and purports to disclosed an air gun where a barrel is aligned with a cylinder and one ball at a time is launched every time a handle connected to a plunger in the cylinder is moved back and then forward. A year later, a U.S. patent issued to Webber, U.S. Pat. No. 5,267,549, entitled "Air-Powered Toy Gun" purports to disclose an air gun having two barrels, one over the other, and a cylinder behind the barrels with a piston connected to a handle. When the handle is pulled back a ball in one barrel is fired and when the handle is pushed forward a ball in the other barrel is fired.

In 1994, U.S. Pat. No. 5,292,134, entitled "Ball Catching and Launching Toy," issued to Schlundt and others, and purports to disclose a device that includes a barrel and aligned cylinder and a cup-like head portion at the end of the barrel. The head portion is used for catching a ball, and the ball is secured in the barrel when a handle connected to a piston in the cylinder is pulled rearward, and the ball is fired when the handle is pushed forward. A 2007 published U.S. Application, No. 2007/0034197, for a "Rapid-Firing Projectile Launcher" listing Tschech as inventor, purports to disclose a fixed multiple barrel device with a piston and aligned cylinder arrangement, where a handle connected to the piston draws in air during a back-stroke and compresses air during a fore-stroke to discharge a projectile. A rotatable diverter directs the compressed air to one of several inlets sequentially with each back and forth stroke of the piston. In 2011, U.S. Pat. No. 7,938,110, entitled "Ball Launching Device," issued to Udwin and purports to disclose a compressed air device that includes a barrel tube with a restricted barrel end portion for a ball and an aligned second tube having a sealing ring that acts like a piston. Pulling the second tube rearward allows air to enter the barrel tube, and pushing the second tube forward compresses the air until the ball is discharged.

These patents and application and the devices disclosed are of some interest, however, they do not teach a compact and robust air gun with a two tube configuration where one tube is mounted around the other tube, where there is no relative movement between the two tubes.

SUMMARY OF THE INVENTION

In accordance with the present invention, an advantageous method and several apparatus are described in the form of air gun apparatus that are compact and efficient. The apparatus are also simply constructed, structurally robust and relatively inexpensive.

Briefly summarized, the invention relates to a toy launcher apparatus including a first tube having a closed front end portion and a vent in a rear end portion, a piston movable between forward and rearward positions in the first tube, a rod having a first end connected to the piston, a handle connected to a second, opposite end of the rod, the handle being operable by a user of the apparatus to move the piston between the forward and rearward positions, and a second tube positioned around the first tube to form a chamber between the first and second tubes, the first and second tubes being connected to one another to prevent relative movement and to form an air path extending from a region in the first tube to the rear of the piston, through the vent, and into the chamber toward a projectile mounted to a front end portion of the second tube, wherein upon moving the piston from the forward position to the rearward position air situated in the region to the rear of the piston in the first tube compresses and moves along the air path to discharge the projectile.

The invention also relates to a method for making a toy launcher apparatus including the steps of forming an inner tube with a movable piston and rod, the inner tube having a vent at a rear end portion, mounting an outer tube around the inner tube to form a chamber between the outer and inner tubes, the interior of the inner tube being in communication with the chamber, the inner and outer tubes being affixed to be stationary relative to one another, connecting a projectile restraining seal to a front end portion of the outer tube, mounting a perforated cup rearward of the seal in the chamber, mounting a spring in the chamber for biasing the cup and a loaded projectile forward, and connecting a handle to the rod.

BRIEF DESCRIPTION OF THE DRAWINGS

For the purpose of facilitating an understanding of the invention, the accompanying drawings and detailed description illustrate embodiments thereof, from which the structures, construction, processes and operation and many related advantages of the embodiments may be readily understood and appreciated.

DETAILED DESCRIPTION OF THE EMBODIMENTS

The following description is provided to enable those skilled in the art to make and use the described embodiments set forth. Various modifications, equivalents, variations, and alternatives, however, will be readily apparent to those skilled in the art. Any and all such modifications, variations, equivalents, and alternatives are intended to fall within the spirit and scope of the present invention defined by the below listed claims.

Figure 1:
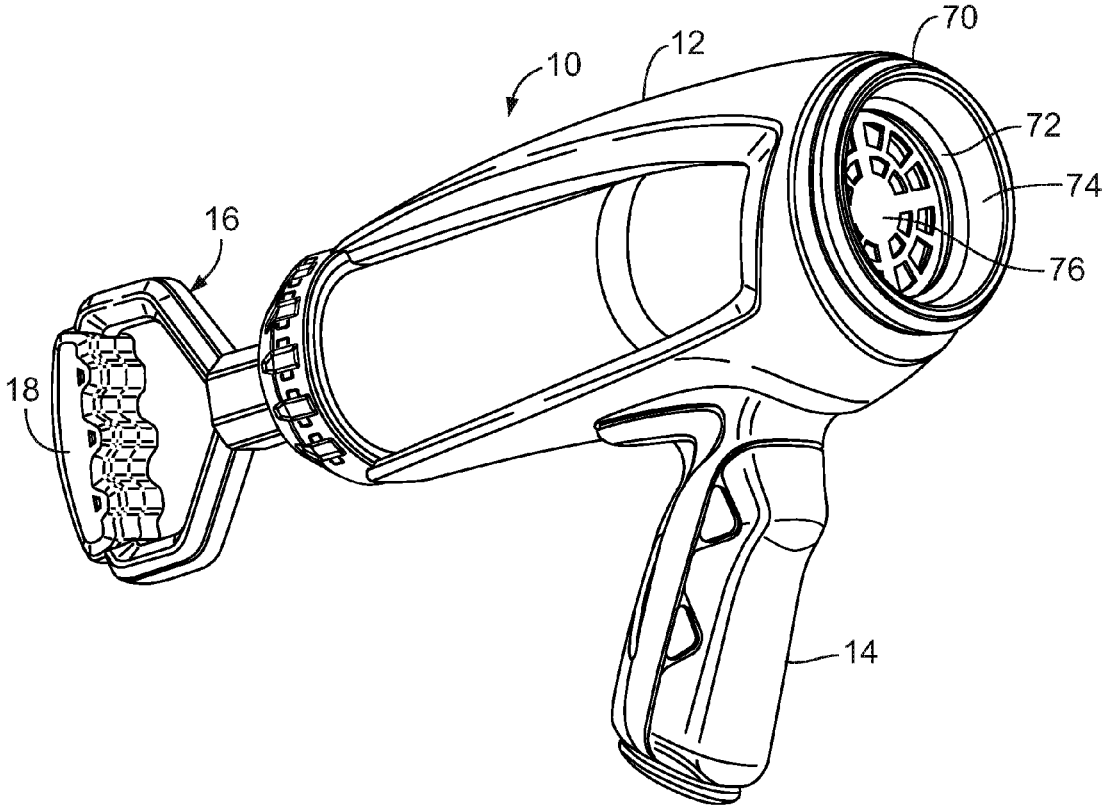
FIG. 1 is an isometric view of the present invention in the form of an unloaded toy air gun apparatus.
Figure 2:
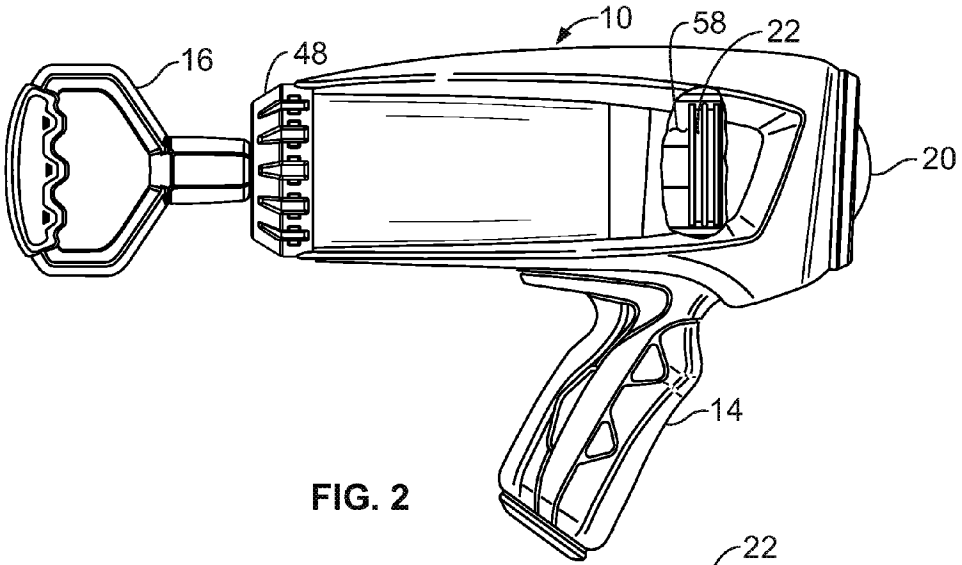
FIG. 2 is a diagrammatic side elevation view, partially broken away, of the air gun apparatus illustrated in FIG. 1, in a loaded configuration with a handle and connected piston in forward positions.
Figure 3:
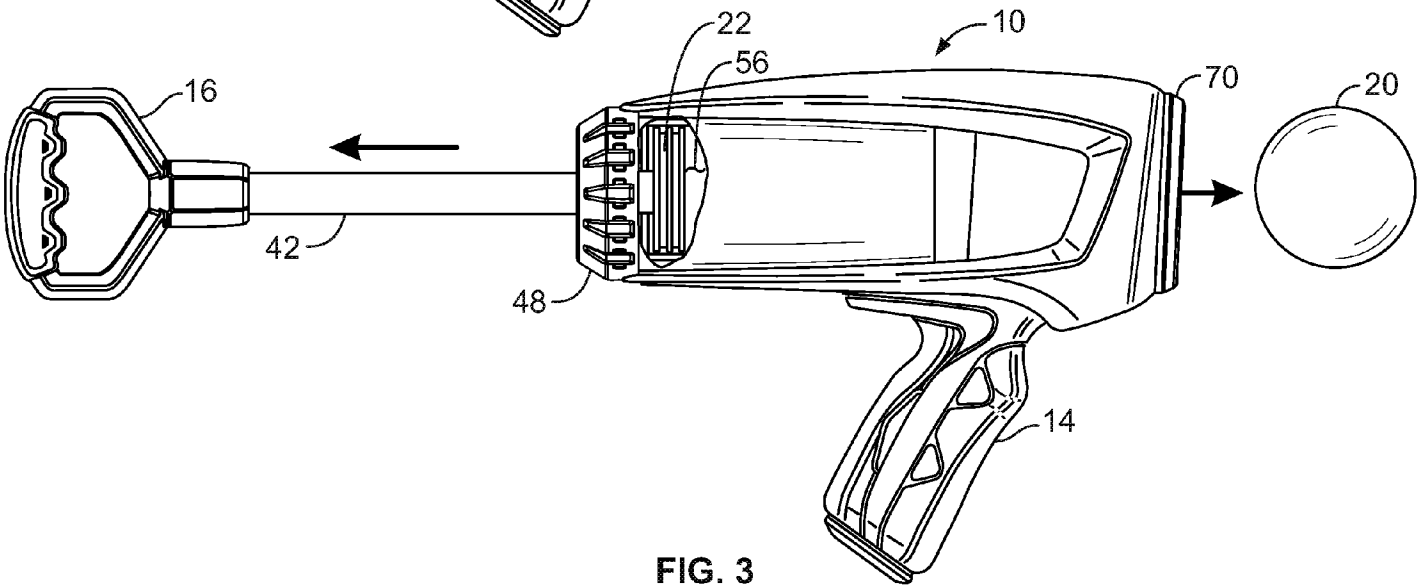
FIG. 3 is a diagrammatic side elevation view, partially broken away, of the air gun apparatus illustrated in FIG. 2, with the handle and connected piston in rearward positions for discharging a ball.

Referring first to FIGS. 1-3, a toy launcher apparatus is illustrated in the form of an air gun 10. The air gun includes a decorative outer shell 12 including a handgrip 14. Extending from the rear of the shell is a handle 16. The handle 16 has a loop shaped grip 18 for ease of operation of the air gun by a user. A projectile in the form of a ball 20 is used with the air gun. The air gun is operated by an operator gripping the loop shaped grip 18 of the handle 16 with one hand and the hand grip 14 with the other hand and moving the handle and a connected piston 22 from a forward position illustrated in FIG. 2, to a rearward position illustrated in FIG. 3, to compress air rearward of the piston 22 and redirect that air forward to discharged the ball 20.

Figure 4:
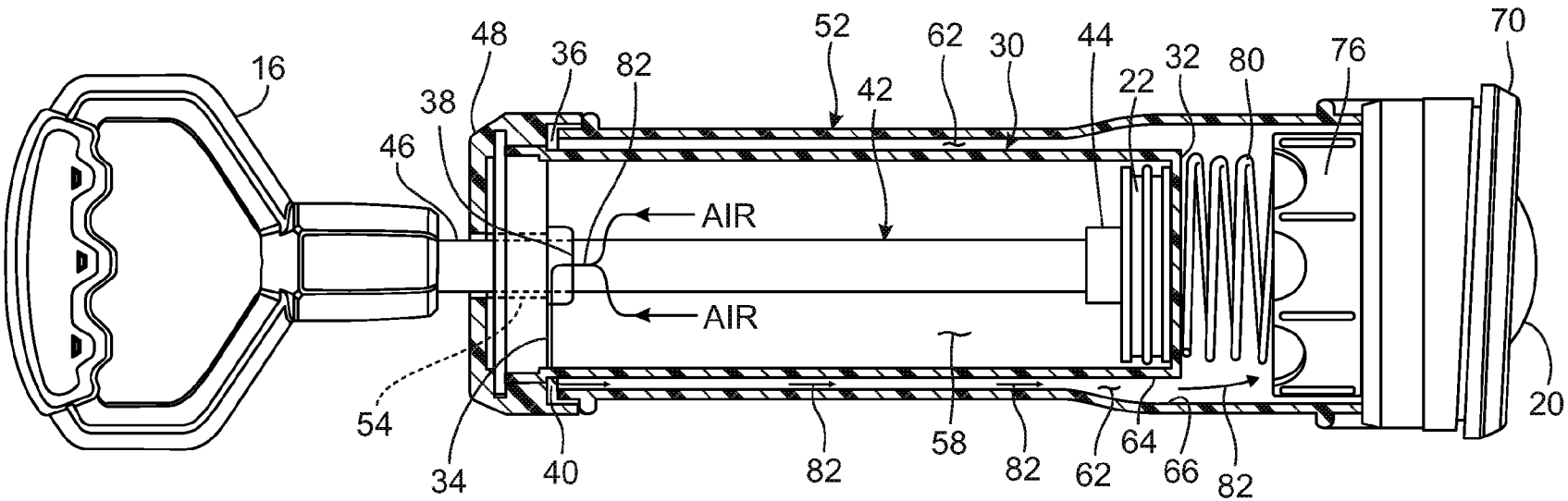
FIG. 4 is an enlarged diagrammatic sectional elevation view of the air gun with an outer shell removed to illustrate connected inner and outer tubes, the piston, a rod and the handle and showing an air path from the inner tube, through a vent in the inner tube, and to the outer tube and the loaded ball.
Figure 5:
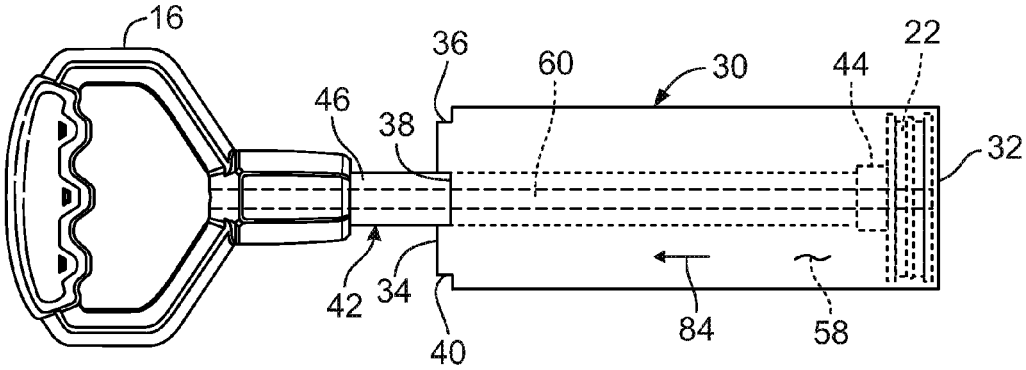
FIG. 5 is a side elevation view of the inner tube, the handle, the rod and the piston.
Figure 6:
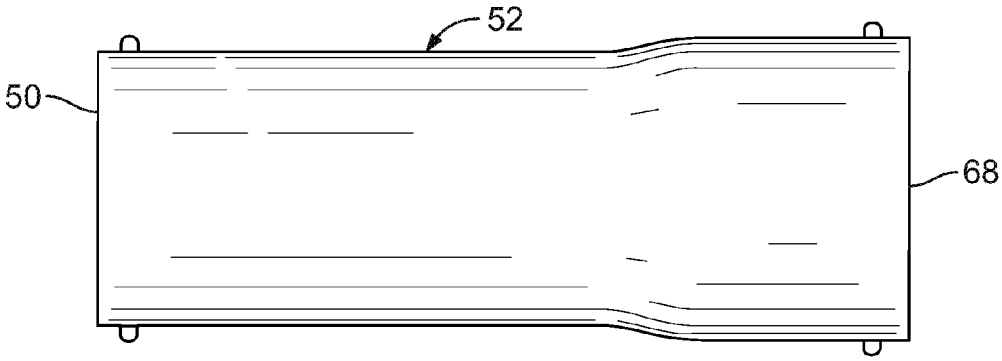
FIG. 6 is an enlarged side elevation view of the outer tube.
Figure 7:
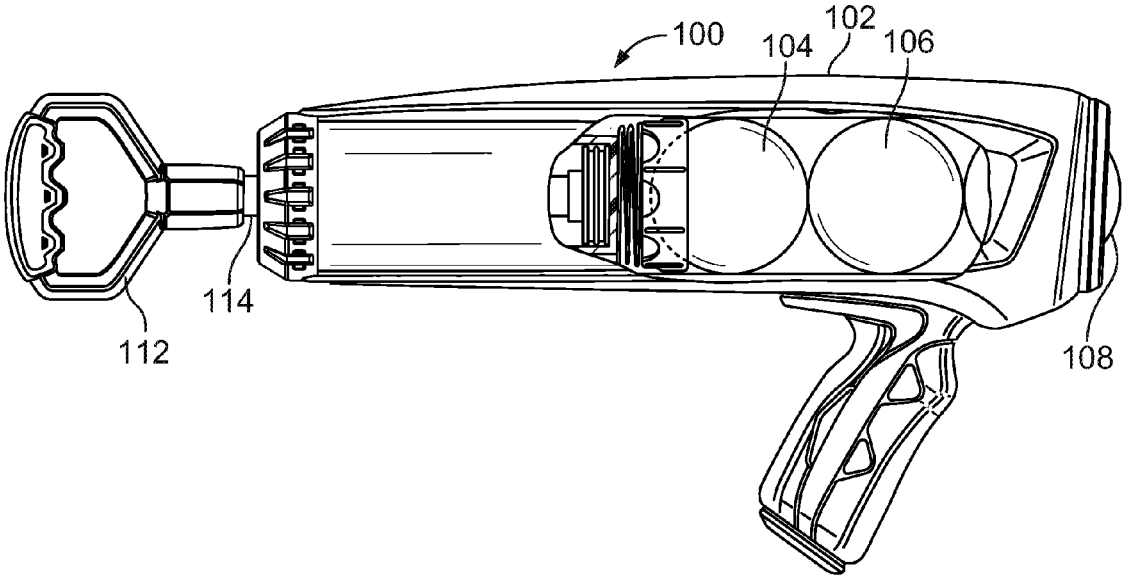
FIG. 7 is a diagrammatic side elevation view of another embodiment of the present invention in the form of an air gun loaded with multiple balls.

As illustrated in FIGS. 4-6, where the outer shell 12, FIG. 1, has been removed, there is a concentric assembly of two tubes including a first or inner tube 30 having a closed front end portion 32 and an open rear end portion 34, the rear end portion having four vents, of which three vents 36, 38, 40 are shown. The term "concentric" is used here to indicate that the longitudinal axes of the two tubes are coincident. Movable in the inner tube between forward and rearward positions is the piston 22. A rod 42 having a first end 44 connected to the piston extends from the piston 22 rearward to the handle 16, to which a second rod end 46 is connected, to enable the piston to be moved back and forth by a user. A rear end cap 48 is affixed to and closes the rear end portion 34 of the inner tube 30 and is also affixed to and closes a rear end portion 50 of the second or outer tube 52. An opening 54 is formed in the rear cap 48 for passage of the rod 42. The piston 22 divides the interior of the inner tube 30 between a first or front region 56, FIG. 3, located forward of the piston and a second or rear region 58, FIG. 2, located rearward of the piston. An air passageway 60, FIG. 5, extends through the piston 22, the rod 42 and the handle 16 to communicate ambient air and the air in the front region 56 forward of the piston 22 in the inner tube.

The outer tube 52 is mounted around the inner tube 30 so as to be stationary relative to one another, and to form an elongated ring-shaped chamber 62 between an outer surface 64 of the inner tube 30 and an inner surface 66 of the outer tube 52. The outer tube 52 includes a front end portion 68, and a front end or barrel cap 70 mounted to the outer tube 52. The barrel cap includes a projectile restraining seal 72, FIG. 1. The barrel cap 70 includes to a forwardly diverging circular surface 74, FIGS. 1, and a perforated cup 76, FIGS. 1 and 4, mounted rearward of the seal 72. A spring 80, FIG. 4, is mounted in the chamber 62 between the inner tube 30 and the perforated cup 76 for biasing the cup and a loaded ball forward to maintain the ball 20 against the seal 72 until discharge of the ball.

The configuration of the inner and outer tubes 30, 52 results in an air path 82, FIG. 4, between the second region 58 in the inner tube 30 to the rear of the piston 22 and a projectile mounted in the barrel cap 70. As the piston 22 is pulled rearward by the user, air in the second region 58 to the rear of the piston, symbolized by an arrow 84, FIG. 5, moves rearward while being compressed and passes through the vents, such as the vent 38 at the rear end portion 34 of the inner tube 30. Thereafter, the compressing air enters the chamber 62, FIG. 4, and moves forward to the ball 20. The rearward movement of the piston continues to compress the air that now moves forward in the chamber 62 and against the ball 20. The air passageway 60, extending through the rod 42, the piston 22 and the handle 16, enables outside air to enter and leave the first region 56 in the inner tube 30 in front of the piston 22 as the handle, the rod and the piston are moved rearward and forward, respectively. This communication maintains the air in front of the piston at about atmospheric pressure so as not to interfere with or make difficult the movement of the piston. After discharge of a ball, the same or another ball may be reloaded rearward of the seal 72 and the operation of moving the handle, the rod and the piston forward and rearward are repeated.

In the alternative, the outer shell may take the form of an old fashioned gun, such as a Colt six-shooter, or a gun having a particular design motif associated with such entertainment features as STARWARS® and TRANSFORMERS®, for example. The outer tube may be extended and more than one ball may be loaded at a time while discharge is maintained at one ball at a time. Or, multiple barrels may be formed at the front end of a launcher with a mechanism to direct compressed air from one barrel to another. Also in the alternative, a projectile other than a ball may be used after the barrel cap is reconfigured and the seal is modified to accept a different shape of the new projectile. More or less vents may be formed in the rear end portion of the inner tube and the tubes need not be concentric, that is the longitudinal axes of the two tubes need not be coincident. The axes may be parallel, but offset, if desired, because the chamber between the two tubes need not be symmetrical to function properly.

It is noted that throughout this description, words such as "forward," "rearward," "front" and "rear," as well as like terms, refer to portions or elements of the launcher apparatus as they are viewed in the drawings relative to other portions, or in relationship to the positions of the apparatus as they will typically be held and moved during play by a user, or to movements of elements based on the configurations illustrated.

In operation, a user loads a ball 20 by pushing the ball from the front passed the seal 72 and against the perforated cup 76. The cup with the spring 80 biases the ball against the seal 72. To cause a discharge, the handle 16, the rod 42 and the piston 22, returned forward after discharging of a previously loaded ball, is pulled rearward by the user. Rearward movement of the piston causes air in the region 58 to the rear of the piston to compress and move rearward in the inner tube 30. The only air path available is through the vents of the inner tube, such as the vents 36, 38, 40 and into the chamber 62 between the inner and outer tubes 30, 52. With the loaded ball in the barrel cap 70 and the spring 80 maintaining the perforated cup against the ball, the barrel cap and the front portion of the outer tube are sealed. The increasing pressure of the compress air builds rearward of the ball until the seal is deformed sufficiently to allow the ball to discharge with a popping sound.

As mentioned above, two alternative launcher embodiments are shown in FIGS. 7-10. An elongated air gun 100, FIG. 7, includes an elongated outer tube under a shell 102 that enables multiple balls, such as the three balls 104, 106, 108 to be loaded and stored. The air gun 100 also includes an inner tube so that the tubes are essentially the same as the tubes 30, 52 of the air gun 10, except that the outer tube is longer. A piston 110 and a rod 114 are located in the inner tube and are connected to a handle 112, just like the air gun 10. The air gun 100 operates in the same manner as the air gun 10; with each rearward and forward movement of the handle, the rod and the piston, only one ball is discharged. The rearward and then forward motions of the piston may be repeated until after three such cycles all three balls have been discharged. Thereafter, the gun may be reloaded with one, two or three balls.

Figure 8:
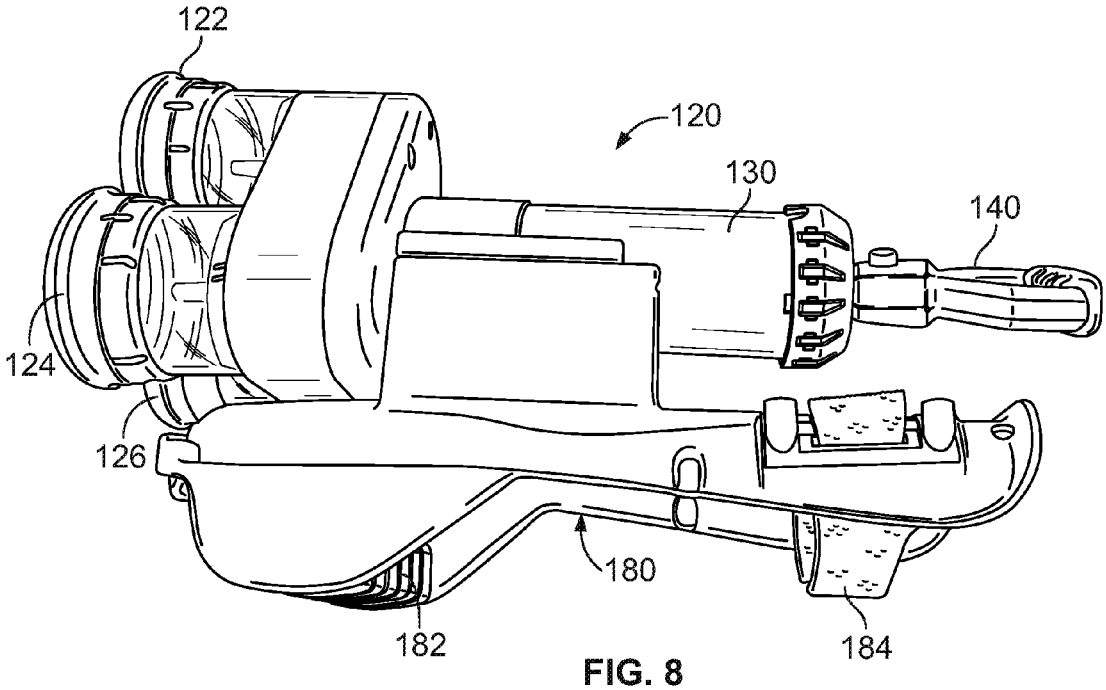
FIG. 8 is an isometric elevation view of a third embodiment of the present invention in the form of an air gun with multiple unloaded barrels.
Figure 9:
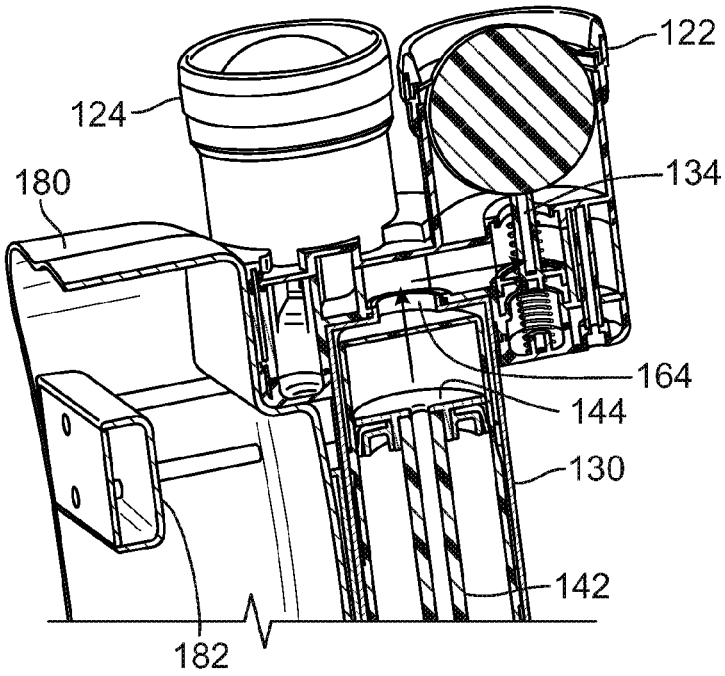
FIG. 9 is a sectional elevation view of the air gun shown in FIG. 8, but rotated about 90° and with two loaded barrels.
Figure 10:
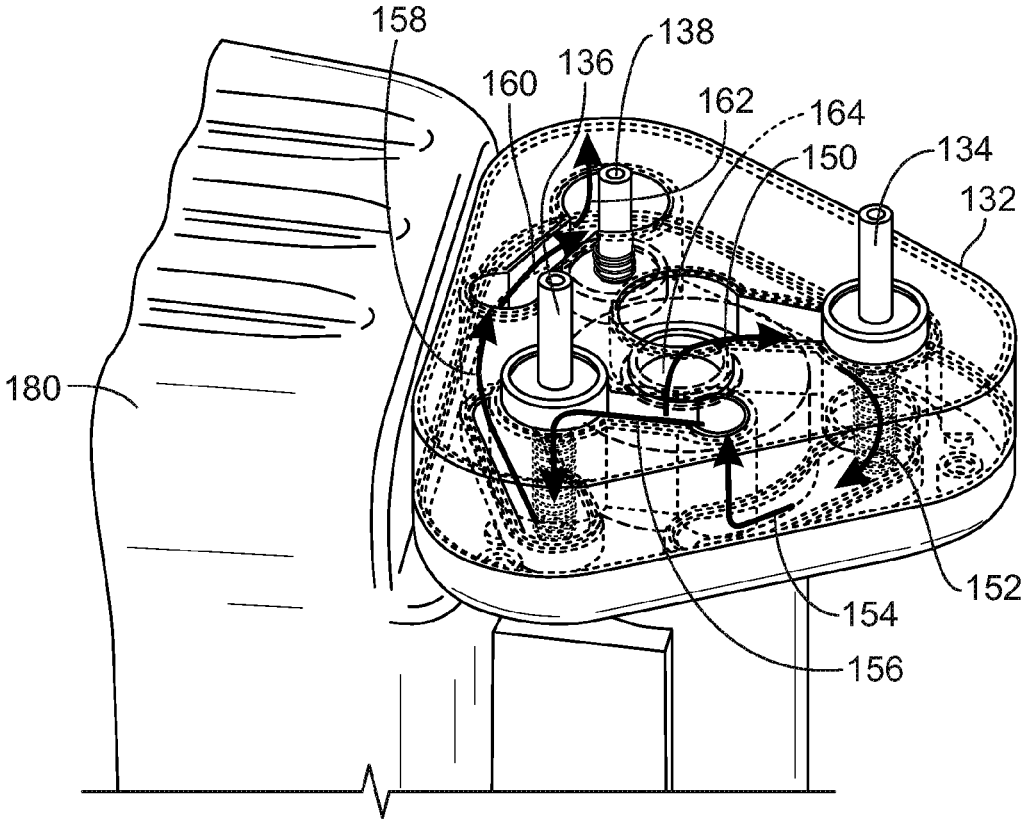
FIG. 10 is an enlarged isometric view illustrating a distribution mechanism in the air gun shown in FIG. 8 and illustrating two posts for unloaded barrels and one post for a loaded barrel.
Figure 11:
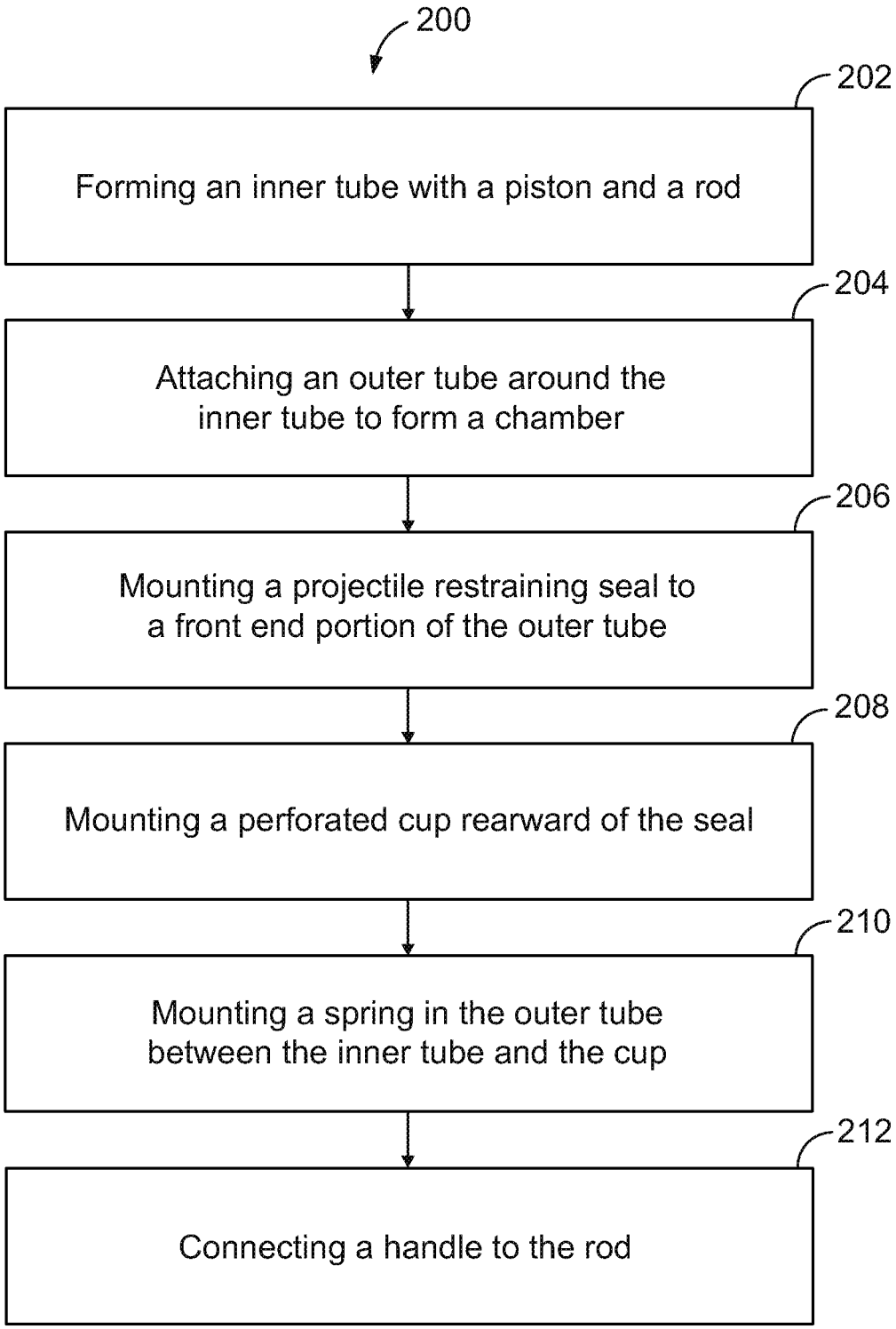
FIG. 11 is a flow diagram for a method of making the toy air guns illustrated in the drawings.

Another air gun 120, FIGS. 8-10, includes three barrels 122, 124, 126 and an air path from a two tube assembly 130 like that described above relative to the air gun 10. The air gun 120 also includes a distributor mechanism 132 having spring biased posts 134, 136, 138, one post in each barrel, that directs air to a loaded barrel while bypassing unloaded barrels each time the handle 140, the rod 142 and the piston 144 complete a cycle of rearward and forward movements.

The compressed air path in the distributor, symbolized by seven arrows 150, 152, 154, 156, 158, 160, 162 enters from a central opening 164 in the front-end portion of the outer tube and passes to the first barrel 122. (See the arrow 150.) Because the first barrel 122 is depicted as empty in FIGS. 8 and 10, the post 134 is raised so that the compressed air is able to bypass the first barrel and proceed to the second barrel 124. (See the arrows 152, 154, 156.) The second barrel is also depicted as empty in FIGS. 8 and 10, and the post 136 is in a raised position to enable the compressed air to bypass the second barrel and proceed to the third barrel 126. (See arrows 156, 158, 160.) Because the third barrel is loaded with a ball, like the barrel 122 is depicted in FIG. 9, the third post 138 is in a lowered position to enable the compressed air to impact the loaded ball. (See the arrow 162.)

The air gun 120 is shown mounted to an arm platform 180, FIG. 8, that includes a grip bar 182 for a user's hand and a strap 184 to be fastened around the user's forearm. This configuration enables the user to carefully aim the air gun with one arm and pull the handle 140 rearward with the free hand of the other arm.

The invention also includes a method 200 for making a toy launcher apparatus including the steps of forming an inner tube with a piston and a rod 202, the inner tube having a vent at a rear end portion, attaching an outer tube around the inner tube to form a chamber between the outer and inner tubes 204, and to communicate the interior of the inner tube with the chamber, mounting a projectile restraining seal to a front-end portion of the outer tube 206, mounting a perforated cup rearward of the seal 208, mounting a spring in the outer tube between the inner tube and the perforated cup for biasing the cup and projectile forward 210 toward the seal, and connecting a handle to the rod 212.

From the foregoing, it can be seen that there has been provided a detailed disclosure of a compact, robust and easily operated toy launcher apparatus and a disclosure of the method for making the toy launcher apparatus. While particular embodiments of the toy launcher apparatus have been shown and described in detail, it will be obvious to those skilled in the art that changes and modifications may be made without departing from the present invention in its broader aspects. Therefore, the aim is to cover all such changes and modifications as fall within the true spirit and scope of the claimed invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A toy launcher apparatus comprising:

a first tube having a closed front end portion and a vent in a rear end portion;

a piston movable between forward and rearward positions in the first tube;

a rod having a first end connected to the piston;

a handle connected to a second, opposite end of the rod, the handle being operable by a user of the apparatus to move the piston between the forward and rearward positions; and a second tube positioned around the first tube to form a chamber between the first and second tubes, the first and second tubes being connected to one another to prevent relative movement and to form an air path extending from a region in the first tube to the rear of the piston, through the vent, and into the chamber toward a projectile mounted to a front end portion of the second tube, wherein upon moving the piston from the forward position to the rearward position air situated in the region to the rear of the piston in the first tube compresses and moves along the air path to discharge the projectile.

2. The toy launcher apparatus of claim 1, including:

a front cap mounted to the front end portion of the second tube;

a projectile restraining seal mounted to the front cap;

a perforated cup mounted rearward of the seal; and a spring mounted in the chamber for biasing the cup and a loaded projectile forward toward the seal.

3. The toy launcher apparatus of claim 1, wherein:

the rod, the piston and the handle include an air passageway communicating a region forward of the piston in the first tube with ambient air.

4. The toy launcher apparatus of claim 1, including:

a rear end cap for closing the rear end portion of the first tube and the rear-end portion of the second tube.

5. The toy launcher apparatus of claim 1, including:

an outer decorative shell mounted around the second tube, wherein the outer shell including a hand grip.

6. The toy launcher apparatus of claim 1, wherein:
the handle includes a loop shaped grip.

7. The toy launcher apparatus of claim 1, including:
a front cap mounted to the front end portion of the second tube;
a projectile restraining seal mounted to the front cap;
a perforated cup mounted rearward of the seal;
a spring mounted in the chamber between the inner tube and the perforated cup for biasing the cup and a loaded projectile forward toward the seal; and
a rear end cap for closing the rear end portion of the first tube and a rear end portion of the second tube.

8. The toy launcher apparatus of claim 7, including:
the rod, the piston and the handle include an air passageway communicating a region forward of the piston in the first tube with ambient air.

9. The toy launcher apparatus of claim 8, including:
an outer decorative shell mounted around the second tube.

10. The toy launcher apparatus of claim 9, wherein:
the outer shell includes a hand grip.

11. The toy launcher apparatus of claim 10, wherein:
the handle includes a loop shaped grip.

12. The toy launcher apparatus of claim 1, including:
a rear end cap for closing the rear end portion of the first tube and the rear end portion of the second tube; and wherein:
the rod, the piston and the handle include an air passageway communicating a region forward of the piston in the first tube with ambient air.

13. The toy launcher apparatus of claim 12, including:
an outer decorative shell mounted around the second tube, wherein the second shell includes a hand grip.

14. A toy launcher apparatus comprising:
an inner tube having a closed front end portion and a vent in a rear end portion;
a piston movable between the front end portion and the rear end portion of the inner tube;
a rod having a first end connected to the piston;
a handle connected to a second, opposite end of the rod, the handle being operable by a user of the apparatus to move the piston between the front end portion and the rear end portion of the inner tube;
an outer tube disposed around the inner tube;
a chamber between the inner and outer tubes; and
an air path from a region in the inner tube to the rear of the piston, through the vent in the rear end portion of the inner tube, through the chamber, and toward a projectile mounted to a front end portion of the outer tube, wherein upon moving the piston by the handle from the front end portion of the inner tube to the rear end portion of the inner tube, air situated in the region to the rear of the piston in the inner tube is compressed and caused to move along the air path to discharge the projectile.

15. The toy launcher apparatus of claim 14, including:
a front cap mounted to the front end portion of the outer tube;
a projectile restraining seal mounted to the front cap;
a perforated cup mounted rearward of the seal; and
a spring mounted in the chamber for biasing the cup and a loaded projectile forward toward the seal.

16. The toy launcher apparatus of claim 15, including:
a rear end cap for closing the rear end portion of the inner tube and a rear end portion of the outer tube.

17. The toy launcher apparatus of claim 16, wherein:
the rod, the piston and the handle include an air passageway communicating a region forward of the piston in the inner tube with ambient air.

18. A toy launcher apparatus comprising:
an inner tube having a closed front end portion and a vent in a rear end portion;
a piston movable between the front end portion and the rear end portion of the inner tube;
a rod having a first end connected to the piston;
a handle connected to a second, opposite end of the rod, the handle being operable by a user of the apparatus to move the piston between the front end portion and the rear end portion of the inner tube;
an elongated outer tube disposed around the inner tube, the elongated outer tube extending beyond the closed front end of the inner tube;
a chamber between the inner and outer tubes; and
an air path from a region in the inner tube to the rear of the piston through the vent in the rear end portion of the inner tube, with the rod and the handle communicating air forward of the piston.

19. The toy launcher apparatus of claim 18, wherein the elongated outer tube extends beyond the closed front end of the inner tube for multiple balls to be loaded and stored.

20. The toy launcher apparatus of claim 18, comprising multiple barrels formed at the elongated outer tube extending beyond the closed front end of the inner tube and further comprising a mechanism thereat to direct air at one or more of the multiple barrels.

* * * * *